US005172348A

United States Patent [19]

Paratte

[11] Patent Number: 5,172,348

[45] Date of Patent: Dec. 15, 1992

[54] WRISTWATCH ADAPTED TO RECEIVE MESSAGES BROADCAST BY RADIO

[75] Inventor: Daniel Paratte, Neuchatel, Switzerland

[73] Assignee: ETA SA Fabriques d'Ebauches, Granges, Switzerland

[21] Appl. No.: 710,441

[22] Filed: Jun. 5, 1991

[30] Foreign Application Priority Data

Jun. 7, 1990 [CH] Switzerland ..... 01 909/90-0

[51] Int. Cl.[5] ..... G04C 11/02

[52] U.S. Cl. ..... 368/47; 368/55

[58] Field of Search ..... 368/47, 55, 59, 27, 368/33

[56] References Cited

U.S. PATENT DOCUMENTS

| | | | |
|---|---|---|---|
| 4,232,512 | 11/1980 | Yoshikawa et al. | 368/82 |
| 4,501,502 | 2/1985 | Van Orsdel | 368/47 |
| 4,629,329 | 12/1986 | Komiyama | 368/47 |
| 4,847,818 | 7/1989 | Olsen | 368/10 |
| 4,884,252 | 11/1989 | Teodoridis et al. | 368/10 |

FOREIGN PATENT DOCUMENTS

| | | |
|---|---|---|
| 1803093 | 3/1959 | Fed. Rep. of Germany . |
| 1207640 | 2/1960 | France . |
| 2464514 | 3/1981 | France . |
| 673748 | 4/1990 | Switzerland . |
| 2171821 | 9/1986 | United Kingdom . |

*Primary Examiner*—Bernard Roskoski

*Attorney, Agent, or Firm*—Griffin Butler Whisenhunt & Kurtossy

[57] ABSTRACT

A wristwatch for receiving messages broadcast by radio, includes the assembly of a movement, a caseband (4) and a back cover (44). The movement comprises a baseplate (13) receiving: a display means (1, 2), a first power cell for controlling the time display a message display cell (16), a first crystal (21), electronic circuits (18), a casing (24) for receiving a second power cell (25) and an antenna formed by a coil including turns (23) wound around the movement and bearing on the first crystal and on the casing. The caseband includes a second crystal (41) and caps the upper part of the movement. The back cover overlays the lower part of the movement and is provided with a side opening (47) giving access to the second power cell to enable changing thereof.

9 Claims, 5 Drawing Sheets

WRISTWATCH ADAPTED TO RECEIVE MESSAGES BROADCAST BY RADIO

FIELD OF THE INVENTION

This invention concerns a wristwatch intended to receive messages broadcast by radio.

BACKGROUND OF THE INVENTION

A timepiece including an antenna adapted to pick up an electromagnetic field bearing messages broadcast by radio has already been described in patent document EP-A-0 339 482 (U.S. Pat. No. 4,884,252) from the same applicant. In one of the embodiments shown, the antenna, entirely confined within the space bounded by the case, is formed by a coil bearing at least one turn, the axis of such coil being arranged parallel to the longitudinal direction of the bracelet. This manner of operation enables the obtaining of a satisfactory signal at the input of the microreceiver with which the watch is equipped. Such document also shows a practical construction in order to put into practice the general concept as declared, but which construction has appeared rather too simplified in terms of the progress of the development work undertaken on the watch in question, to the extent that it has been necessary to improve such construction. Within such improvements, the accent has been placed on criteria leading to a better functioning of the assembly, as for example the surface circumscribed by the turns of the winding which must be as large as possible, the general sealing of the watch and the access to different energy sources, particularly the cell energizing the radio-electric portion which must be frequently replaced.

SUMMARY OF THE INVENTION

It is for this reason that the watch of the present invention includes in combination the assembly of the following elements:

- a movement comprising a baseplate on which are mounted time displaying means, a first energy source for controlling said means, a display cell for broadcast messages, a first crystal overlaying said displays, electronic circuits to control said displays, a casing for receiving a second energy source intended to energize the electronic circuits controlling said display cell for broadcast messages and an antenna for picking up said messages, said antenna being formed by a coil including a plurality of turns wound around the movement and bearing at least on the first crystal and on the casing,
- a caseband on which a second crystal is fixed and in which the upper part of said movement is placed, and
- a back cover secured to the caseband and overlaying the lower part of the movement, the back cover being provided with a lateral opening giving access to the second energy source to enable its replacement.

The invention will now be explained in detail in referring by way of example to the drawings illustrating a preferred embodiment thereof.

DESCRIPTION OF THE PREFERRED EMBODIMENT

Figure 1:
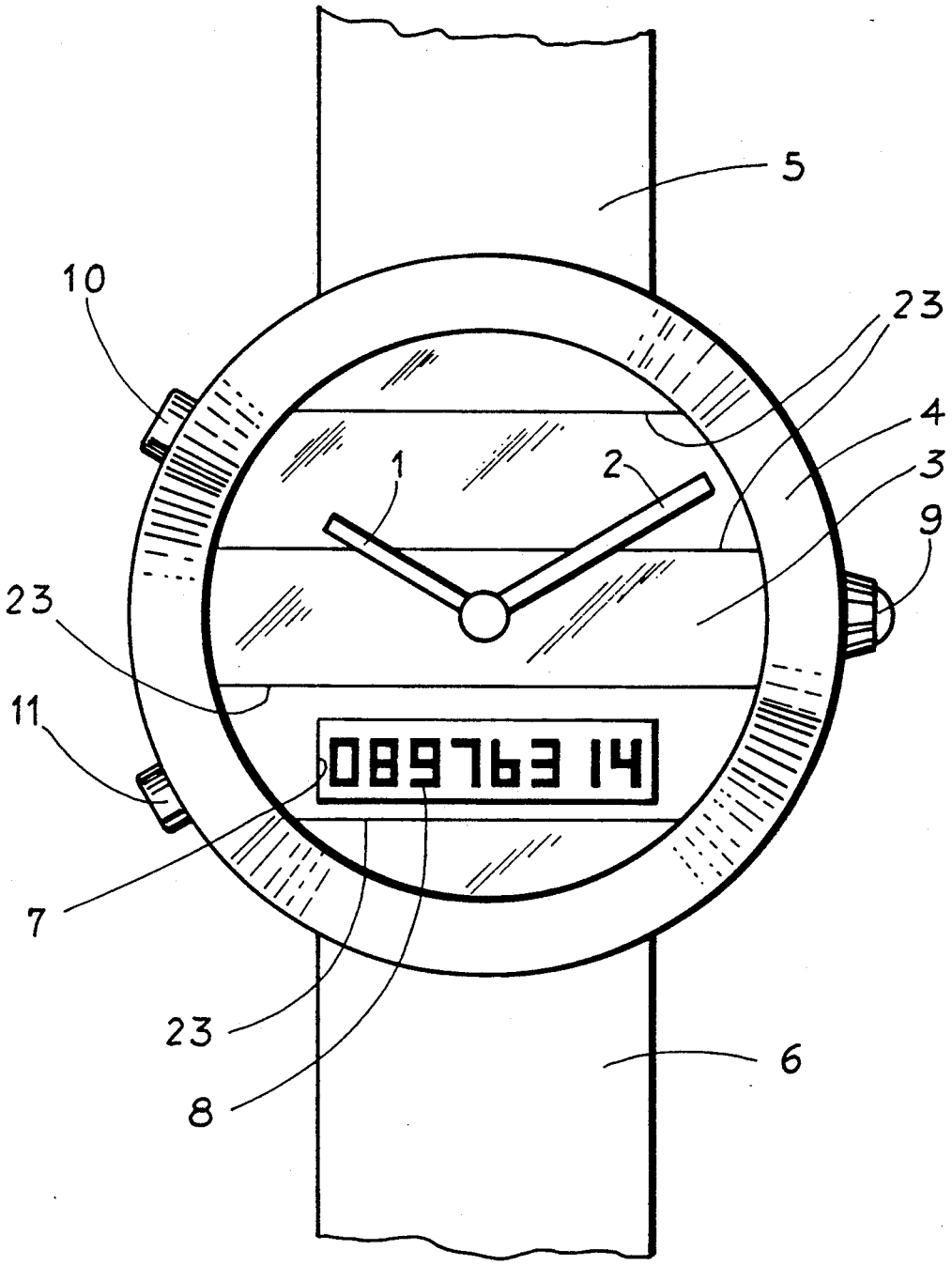
FIG. 1 is a top view of the watch according to the invention.

FIG. 1 is a summary view of a wristwatch according to the invention. It includes analog display means for the time of day with an hours hand 1 and a minutes hand 2, such hands rotating over a dial 3. On FIG. 1, there is seen the caseband 4 of the watch as well as strands 5 and 6 of a bracelet attached thereto. In an opening 7 cut through dial 3, there appears a display cell 8 for radio broadcast messages which assume a digital form and which may consist for instance of a telephone number to be called back. The watch is completed by a crown 9 for time setting the time display, by a first push-button 10 enabling the starting or stopping of the radio portion of the watch, and by a second push-button 11 for preventing operation of the acoustic warning (buzzer) mounted within the watch. FIG. 1 shows the receiving antenna of the watch which takes the form of four wires 23 constituting the antenna coil the axis of which is arranged in parallel to the longitudinal direction of the bracelet. Such direction is preferred to others since it is this which provides at the terminals of the coil the signal exhibiting the greatest amplitude, as has been recalled hereinabove in reference to document EP-A-0 339 482.

FIGS. 2 to 5 are cross-sections taken in the watch of FIG. 1 which explain its organization in detail. As a general rule the watch of the invention includes three important basic elements, a movement 12, a caseband 4 and a back cover 44.

Figure 2:
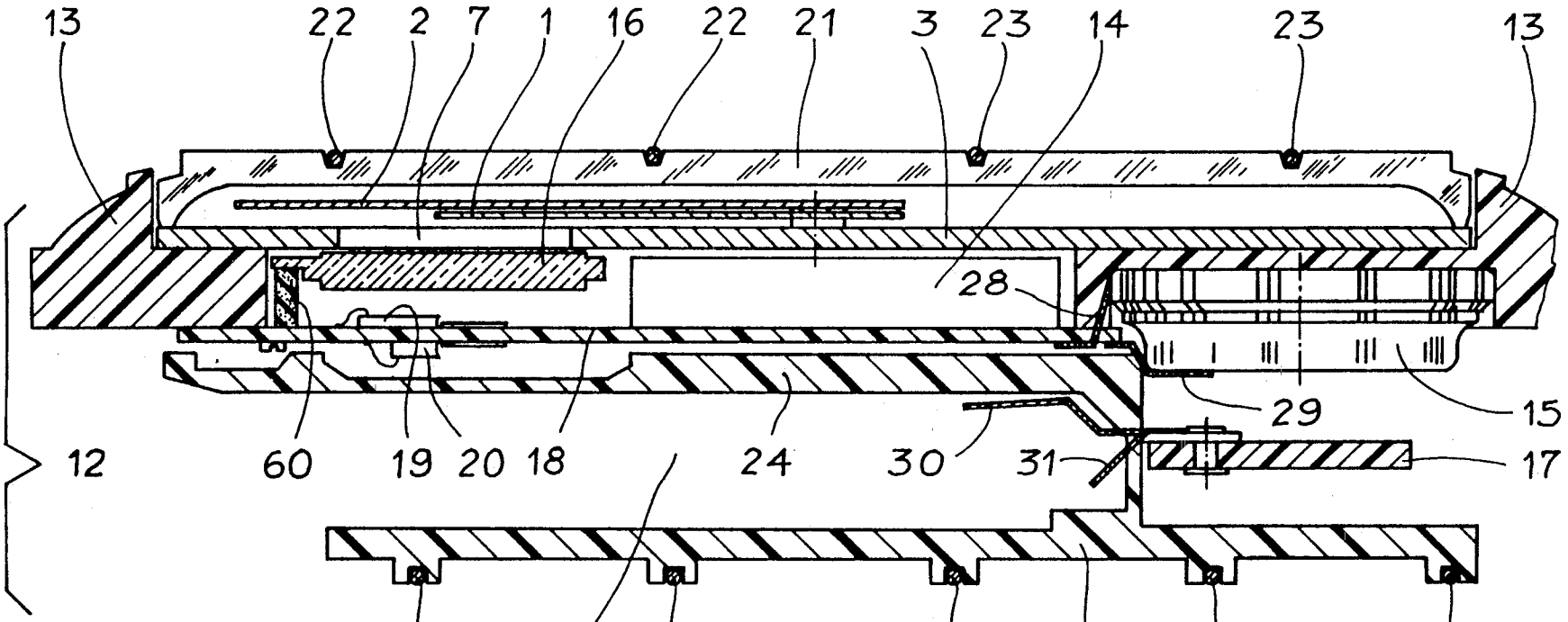
FIGS. 2 and 3 are cross-sections taken in FIG. 1 showing the elements constituting the movement as such of the watch.
Figure 3:
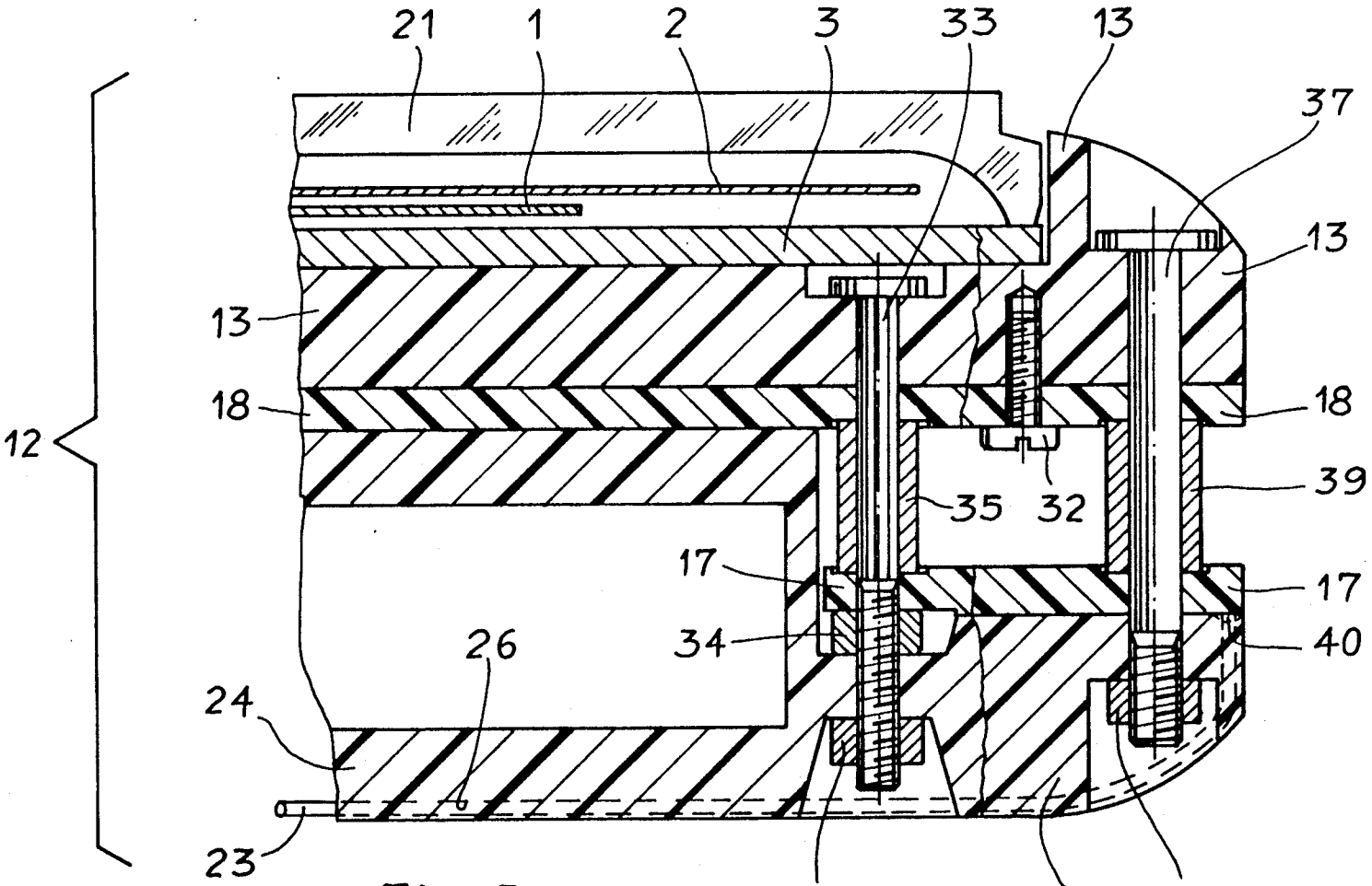

FIGS. 2 and 3 show details of the watch movement.

By referring in particular to FIG. 2, one sees that movement 12 exhibits a baseplate 13 which serves to support various elements now to be reviewed. To baseplate 13 one finds attached initially time display means which consist, in the Figure taken as example, in a mechanism 14 driving the hours hand 1 and minutes hand 2. Such mechanism may be itself driven in a known manner by a stepping motor (not shown). The invention is not limited to an analog time display, such display also possibly taking a digital form. The time display means are controlled from a first energy source 15 consisting of a cell arranged in a housing in the baseplate 13. FIG. 2 shows that the baseplate also bears a display cell 16 intended to cause radiobroadcast messages to appear. The time display hands pivot above dial 3, itself provided with an opening 7 allowing one to see the indications displayed by cell 16. Dial 3 rests on baseplate 13.

The time displaying hands 1 and 2 as well as the display cell 16 are covered over by a first crystal 21 which rests on the periphery of dial 3. Such crystal bears transversal grooves 22 intended to receive the wires 23 of the antenna as will be seen hereinafter.

Likewise attached to baseplate 13, movement 12 further includes electronic circuits in order to control the displays mentioned hereinabove. In the case of FIG. 2, such electronic circuits comprise two distinct modules, a first module 17 and a second module 18. The first module 17 referred to as radio-frequency (RF) module, receives the signal picked up by the antenna which will be described hereinafter, amplifies such signal and demodulates it. The second module 18 referred to as the digital module, receives the signal from the first module in order to control the display cell 16, for example through a zebra connector 60. One may find on such second module 18, in accordance with the functions with which it is desired to equip the watch, a decoder, a microprocessor and further a RAM memory. In the example, the digital module 18 further bears electronic elements necessary in order to excite the stepping motor driving the mechanism 14, in particular a quartz, a frequency divider and a driver. Such various elements are symbolized by rectangles bearing references 19 and 20.

FIG. 2 finally shows a casing 24 attached under the baseplate 13 and this according to a construction appearing on FIG. 3. Such casing pursues a double purpose, initially that of serving as housing 27 to a second energy source or cell 25 (FIG. 5) and finally that of serving as a guide to the antenna wires 23. To this latter effect FIG. 2 shows that the bottom of casing 24 is also provided with grooves 26 in which repose the antenna wires 23.

The cell 15 intended to energize the time display mechanism is coupled electrically to the digital module 18 by connections 28 and 29. Cell 25, intended to energize the RF and digital modules is coupled to the RF module by connections 30 and 31.

FIG. 3 is a cross-section in movement 12 of the wristwatch, the planes of the cross-section being chosen in a manner such that the manner of attaching the various elements shown on FIG. 2 among themselves are rendered apparent. There is recognized in FIG. 3 the baseplate 13, the digital module 18, the RF module 17 and the casing 24. The digital module 18 is fastened to baseplate 13 by means of screws 32, a single one of which is shown on the drawing. As soon as the digital module 18 is mounted on the baseplate, the RF module 17 is mounted on the digital module by means of a threaded rod 33 driven into baseplate 13 and a nut 34, a sleeve 35 being arranged between the two modules in order to maintain a predetermined separation. Thereafter, casing 24 is mounted and is attached to baseplate 13 on the one hand by rod 33 and a nut 36 and on the other hand by two further rods 37 each receiving a nut 38, with a sleeve 39 being arranged between modules 17 and 18, a single one of rods 37 being shown on the drawing. One finishes the assembly of movement 12 in placing dial 3, hands 1 and 2 and the first crystal 21 on its upper portion. One then has available a movement forming a compact entity around which one may wind the antenna wire 23, such wire being received in the grooves 26 and 22 respectively provided in the lower portion of casing 24 and on the upper portion of the first crystal 21. FIG. 3, which shows only groove 26 brings into view one of the ends of the antenna wire 23 soldered to the RF module 17 by a drop of solder 40. Here there will be noted that the sleeves 35 and 39 may serve as electrical conductors between the two modules if such sleeves are metallic.

The compact movement 12 further bears a buzzer which will be described having reference to FIG. 5. As soon as such movement is entirely assembled, one proceeds to assemble the first energy source or cell 15 which has been shown on FIG. 2. Such cell energizes only the portion displaying the time of day and thus should be of long life (two to three years). In order to replace it, it will however be necessary to take the movement 12 out of the caseband and back cover in which it is mounted.

Figure 4:
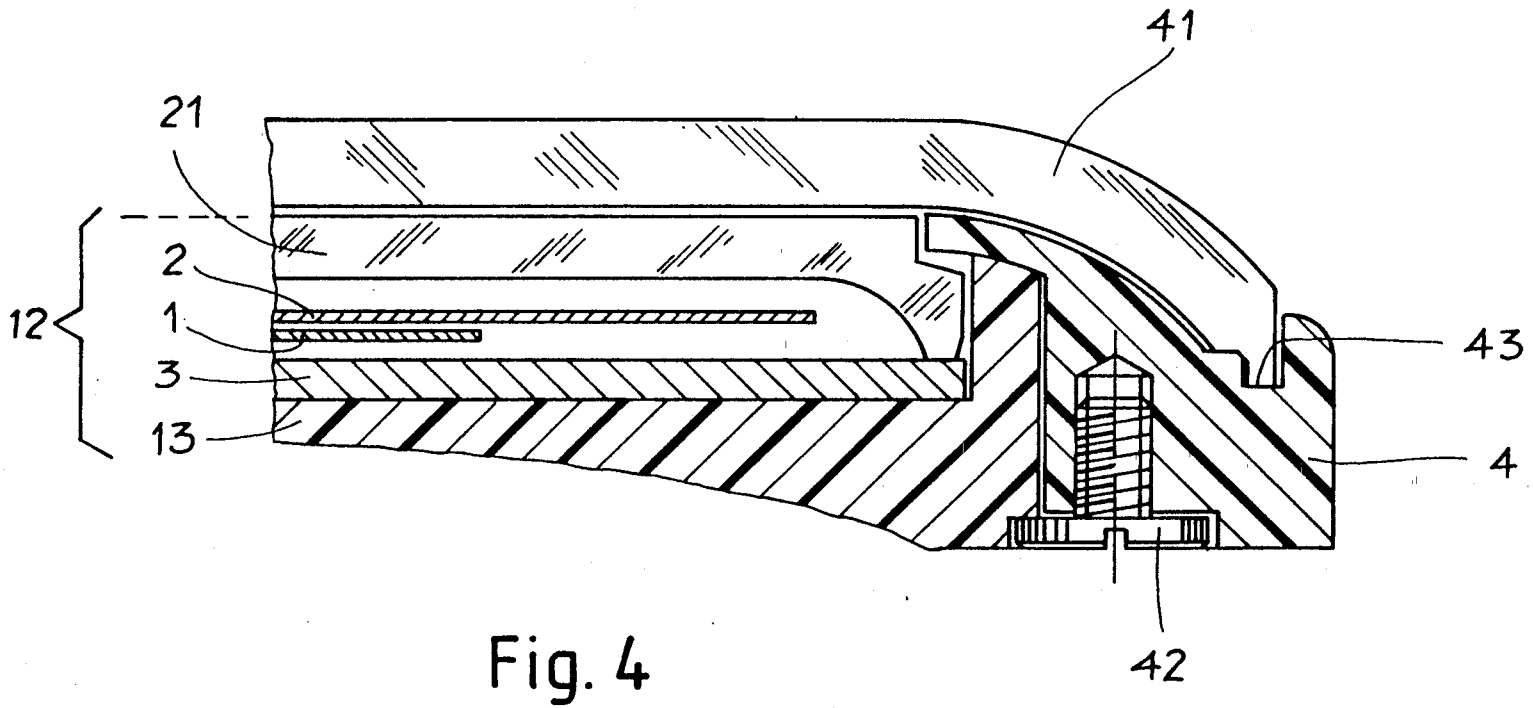
FIG. 4 is a cross-section taken in FIG. 1 showing how the movement is secured to the caseband of the watch.

FIG. 4 shows that movement 12 for which there has only been here shown certain essential elements is assembled to a caseband 4 surmounted by a second crystal 41. The securing of the movement to the caseband is brought about by means of two fastening screws 42, a single one of which is shown on the drawing. Crystal 41 rests on a peripheral groove 43 provided in the caseband where it may be secured by ultrasonics, this assuring a sealed connection between the two elements in question.

As soon as the movement 12 is secured to caseband 4, there remains nothing more in order to terminate the assembly of the watch than to fasten thereto a back cover 44. FIG. 5 shows the watch completely assembled. In the watch taken by way of example, back cover 44 is fastened to caseband 4 by means of six screws 45 a single one of which has been shown on the drawing. Each screw is screwed into a threaded insert 46 forced into caseband 4. FIG. 5 also shows that an opening 47 is provided laterally in back cover 44 such opening giving access to the second energy source or cell 25 in order to permit replacement thereof. In the case of the watch of the invention, it is important that cell 25 may be readily replaced by the wearer of the watch since the life duration of such a cell, energizing all the radio-frequency and digital circuits, which consume substantial quantities of energy, is relatively short, say three to four months, taking into account the relatively small dimensions of such cell 25. Such cell may not be replaced via an opening situated under the back cover because of turns 23 forming the antenna, the sole access possibility being that of a lateral opening situated perpendicularly to an axis parallel to the longitudinal direction of the bracelet.

Figure 5:
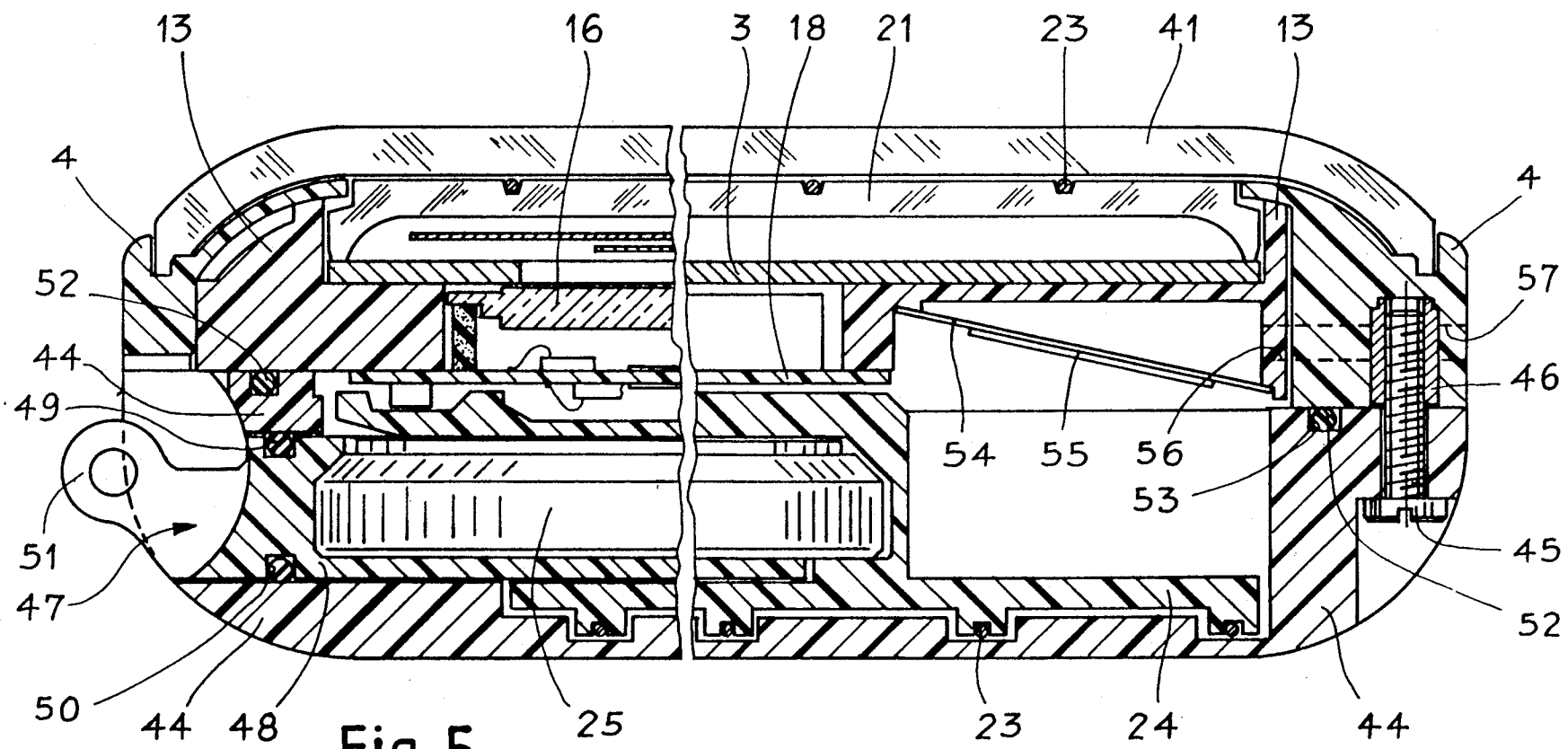
FIG. 5 is a cross-section taken in FIG. 1 and showing the assembly of the watch according to the invention following attachment of a back cover.

In order to facilitate extraction of cell 25, FIG. 5 shows that such cell is housed in a drawer 48 sliding in the casing 24, the sealing of the drawer being assured by a packing 49 housed in a groove 50 and bearing against back cover 44. In the preferred embodiment of the invention shown on the drawing, it is seen that the drawer may be attached by its outer portion 51 to one of the two strands making up the bracelet, this facilitating the removal of cell 25. In such case, however, securing means, for instance retractable dogs (not shown) are employed in order to fasten the drawer 47 to the back cover 44.

Examination of FIG. 5 further shows that the watch is sealed by a packing 52 arranged between caseband 4 and back cover 44 and housed in a groove 53 provided in the back cover. The cross-section plane of the right hand portion of FIG. 5 has been chosen in order to permit showing an acoustic transducer which is composed of a membrane 54 to which is glued a piezoelectric transducer 55. In order to permit audible waves to be propagated to the outside of the case, channels are provided in the baseplate and the caseband respectively referenced 56 and 57. The transducer 55 (buzzer) warns the wearer of the watch that a message has arrived.

What I claim is:

1. A wristwatch for receiving messages broadcast by radio including in combination:

a movement comprising a baseplate on which are mounted time display means, a first energy source for controlling said time display means, a display cell for broadcast messages, a first crystal overlaying said display means and said display cell, electronic circuits for controlling said time display means and said display cell, a casing for receiving a second energy source, said second energy source energizing the electronic circuits controlling said display cell for broadcast messages, and an antenna for picking up signals representing said messages, said antenna being formed by a coil including a plurality of turns wound around said movement and bearing at least on said first crystal and on said casing, a caseband on which a second crystal is fixed and in which an upper part of said movement is placed, and, a back cover secured to said caseband and overlaying a lower part of said movement, said back cover having a lateral opening giving access to the second energy source to enable its replacement.

2. A wristwatch as set forth in claim 1, wherein said first crystal and said casing bear grooves in which rest said turns of said coil.

3. A wristwatch as set forth in claim 1 in combination with a bracelet, said coil having an axis parallel to the longitudinal direction of said bracelet.

4. A wristwatch as set forth in claim 1 wherein said second energy source is housed in a drawer sliding in said casing.

5. A wristwatch as set forth in claim 4 in combination with a bracelet said drawer being attached to a strand of said bracelet and said coil having an axis arranged parallel to the longitudinal direction of said bracelet.

6. A wristwatch as set forth in claim 1 wherein said electronic circuits include a first radio frequency module responsive to signals picked up by said antenna for producing a further signal and a second digital module receiving said further signal from said first module in order to control said display cell, said first and second modules being secured to said baseplate.

7. A wristwatch as set forth in claim 1 wherein said second module also bears means for controlling said time display means.

8. A wristwatch as set forth in claim 1 wherein said time display means include hands moving over a dial, said hands being driven by a mechanism provided with a stepping motor.

9. A wristwatch as set forth in claim 1 wherein said movement further includes an acoustic transducer for warning the watch wearer of the arrival of a message.

* * * * *